United States Patent [19]

Caswell et al.

[11] 4,384,018

[45] May 17, 1983

[54] SECONDARY CARPET BACKING FABRIC

[75] Inventors: Donald Caswell; David J. Stout, both of Waynesboro, Va.

[73] Assignee: Wayn-Tex Inc., Waynesboro, Va.

[21] Appl. No.: 342,220

[22] Filed: Jan. 25, 1982

[51] Int. Cl.[3] ..... B32B 3/02

[52] U.S. Cl. ..... 428/95; 28/104; 57/238; 57/260; 139/420 R; 264/DIG. 47; 428/221; 428/222; 428/225; 428/227; 428/258; 428/259; 428/257

[58] Field of Search ..... 428/225, 227, 229, 257, 428/258, 259, 95, 221, 222; 264/121, DIG. 47; 28/103, 271, 274, 275, 104; 57/238, 239, 244, 245, 260, DIG. 907, DIG. 908; 139/426 R, 420 R

[56] References Cited

U.S. PATENT DOCUMENTS

| | | | |
|---|---|---|---|
| 3,535,192 | 10/1970 | Gamble | 428/95 |
| 3,542,632 | 11/1970 | Eickhoff | 428/225 |
| 3,583,890 | 6/1971 | Holckmann | 428/95 |
| 3,695,025 | 10/1972 | Gibbon | 57/260 |
| 3,718,530 | 2/1973 | Watson | 428/96 |
| 3,817,817 | 6/1974 | Pickens | 428/95 |
| 3,884,030 | 5/1975 | Baxter et al. | 57/260 |
| 3,922,454 | 11/1975 | Roecker | 428/95 |
| 4,145,467 | 3/1979 | Malik | 428/95 |
| 4,156,957 | 6/1979 | McKay | 428/226 |

*Primary Examiner*—James J. Bell

*Attorney, Agent, or Firm*—Amster, Rothstein & Engelberg

[57] ABSTRACT

An improved woven synthetic textile fabric is formed by using an entangled combination of a fibrillated slit film yarn and a multi-filament yarn as at least one of the warp and fill members. The fabric is characterized by the look and feel of a jute fabric and may be employed as a woven cloth to manufacture bags, bale wrap, wall covering, drapes and the like or, preferably, to produce secondary backing fabric for tufted carpets which exhibits enhanced adhesion characteristics as compared to prior art synthetic secondary backing materials.

8 Claims, No Drawings

SECONDARY CARPET BACKING FABRIC

This invention relates generally to woven textile fabrics made from synthetic materials. The fabrics are useful to replace burlap, jute and other natural fiber textiles in the manufacture of primary and secondary backings and in the production of sacks, bags, bale wrap, wall covering, drapery and the like. Particularly, the present invention relates to secondary carpet backings exhibiting improved adhesion characteristics which are formed from novel warp or fill members.

In the manufacture of quality pile fabrics such as carpets and the like, a face is secured to a fabric which can be denominated the ground member or primary backing by weaving, tufting or needle-punching a staple fiber thereinto. An adhesive, such as rubber latex or a hot melt adhesive, is then applied to the backside, and a second backing is laminated thereto. For a long period of time, the secondary backing in quality pile fabrics, particularly carpet fabrics, was almost exclusively a jute fabric. More recently, attempts have been made to prepare synthetic secondary backings to replace those heretofore made of jute.

In terms of price and strength, the polyolefins, in particular among synthetics, are extremely attractive and offer, in addition to their renowned resistance to chemicals, water, miidew, etc. It is not surprising therefore that a number of prior art patents, including specifically U.S. Pat. Nos. 3,542,632; 3,282,788; 3,317,366; and 3,549,470, describe various types of secondary backing fabrics formed from polyolefins. However, the use of such polyolefin backings has not met with complete success mainly because of their poor adhesive qualities and because polyolefin materials treated so as to improve adhesion either have no fabric strength or have an aesthetically unacceptable appearance.

Malik U.S. Pat. No. 4,145,467, which is owned by the assignee of this application, describes a secondary backing formed from polyolefin materials which represents a distinct improvement over prior art synthetic secondary backing materials. The woven fabric of Malik comprises polyolefin ribbon as one of the warp and fill members and heavily fibrillated polyolefin ribbon as the other member. In those instances where the Malik fabric is intended for use as a secondary carpet backing material, it is necessary to treat the fabric to disconnect the fibrils of the fibrillated member from the web and raise the ends above the surface of the fabric. This is accomplished by needle-punching, brushing or some similar operation. Alternately, Malik contemplated the treatment of the heavily fibrillated ribbon prior to the weaving operation to accomplish fibril end raising. In either event, the adhesion improving treatments increased the cost of the fabric and resulted in delamination strengths which, although exceeding the minimum industry standard for acceptability, were significantly below the values obtainable with natural jute fabrics.

It is an object of this invention to provide improved textile fabrics of the type described in the Malik patent which exhibit improved delamination strengths without the need for special fabric treatments designed and intended to raise the fibril ends of the fibrillated warp or fill member.

Yet another object of this invention is to provide a novel warp or fill member for woven textile fabrics which exhibits significantly improved adhesion characteristics.

It has now been discovered that an improved fabric can be formed by employing, as one of the warp or fill members, a yarn comprising an entangled combination of heavily fibrillated polyolefin ribbon and a synthetic continuous filament yarn. Entanglement is preferably accomplished by bringing together the fibrillated ribbon and filament yarns in a fluid jet of the type heretofore employed in the prior art for various filament treating and texturizing purposes. The other member of the woven fabric may be any synthetic yarn but preferably comprises unfibrillated or substantially unfibrillated synthetic ribbons, preferably polyolefin ribbons. Fabrics woven from the foregoing combination of synthetic components exhibit a combination of good strength, the appearance and low cost of a jute fabric and superior adhesion as synthetic secondary carpet backing fabric as compared to most synthetic materials heretofore used in the art. Further, the combination of materials exhibits excellent novelty effects making the fabric suitable for use in wall coverings, curtains and upholstery materials as well as backing materials.

This invention constitutes an improvement in the invention described in Malik U.S. Pat. No. 4,145,467, and the basic disclosure of that patent with respect to the preparation of fibrillated ribbon and the formation of fabrics is also applicable to the present invention. Accordingly, that disclosure is incorporated herein by reference to the extent that its teachings are consistent with the disclosure set forth hereinafter.

The fabric of the invention is preferably woven in a conventional leno weave using synthetic ribbons as either the warp or fill members and the entangled fibrillated ribbon/multi-filament yarn combination as the other member. Other weave constructions, for example, plain, twill, broken twill, satin or sateen, basket, etc., can all be used to good advantage and may sometimes be preferred if it is desired to have more or less fibrillated material exposed on one side of the fabric. In general, almost any weave construction known to the textile artisan can, with his ordinary skill, be used in forming fabrics from the novel yarn construction of the invention.

When the fabric is intended to be used as a secondary backing, it is usually woven so as to have an open structure to facilitate passage of the adhesives normally used to adhere the backing to pile fabrics for carpet structures. In this context, the weave can be one that has from about 14 to about 19 ribbon ends per inch (warp), of about 450 to about 550 denier and from about 6 to about 10 entangled fibrillated ribbon multi-filament yarn picks (fill) or ends per inch (warp) of about 1200 to about 2000 denier. Useful secondary backings are obtained when the fabric has 16 ribbon warp ends per inch and 7.5 entangled fibrillated ribbon multi-filament fill picks, as well as when the fabric has 18 ribbon warp ends per inch and about 8 entangled fibrillated ribbon multi-filament fill picks. Useful primary backings are obtained when the fabric has from 11 to about 25 warp ends per inch and from about 10 to about 13 entangled fibrillated ribbon multi-filament fill picks. The weaving specifics are not critical, and as noted above are considered to be within the skill of the art and will depend upon the characteristics desired for the resultant fabric in its end use. Moreover, the fabric can also be prepared by reversing the materials used for each of the warp and fill members with the warp end count and fill picks being correspondingly altered so that the count of the entangled fibrillated ribbon multi-filament members remains approximately the same.

The term "ribbon" used herein, means that the members or components of the warp and/or fill woven into the fabric preferably have a flat appearance and are generally rectangular in cross-section. For the purposes of the present invention, a "ribbon," "ribbon yarn" or member, etc., as used herein includes, in addition to the above, tapes, tubes, sheets or strips of synthetic resinous material whether or not of rectangular cross-section. Thus, other cross-sectional shapes, round, oval, the so-called "dump bell" and combinations of these shapes can be used. Multi-filament ribbons are also within the purview hereof, whether held together as by adhesives, or loosely combined in a continuous cluster to form a warp or fill member of the fabric, and whether fibrillated or not. Inclusive herein are other terms such as narrow films, strands, bands, fibers, threads, yarns and yarn elements whether monofilament constructions or multi-filaments and whose cross-sections may vary from round to rectangular, uniform or non-uniform, or symmetrical or asymmetrical.

Ribbons or ribbon yarns can be made by slitting a film or by extrusion from individual orifices depending upon their form and shape. In either method, the material of the ribbons is oriented, usually by drawing. Final ribbon dimensions are determined by the amount or degree of orientation and original dimensions of the ribbons prior to orientation.

By heavily fibrillated members or ribbons is meant a product or fiber which is formed into structure having many fibers or fibrils which have lower deniers than the original product. The fibrils may be connected with one another or not, depending upon the method of fibrillating the ribbon. The ribbon may be formed into a web or net-like structure consisting of one or more, more or less parallel, longitudinally extending backbones or stem-like fine fibrils connected by even finer fibrils. This structure can be formed by any well-known method. For example, a rotating pin roller consisting of spaced rows of pins mounted on the periphery of a roller can be used. The ribbon is drawn over the roller at a speed somewhat less than the peripheral speed of the roller whereby laterally spaced apart, longitudinally extending perforations or slits disposed in spaced, staggered parallel relationship are formed in the ribbon, the slits being so disposed that expansion of the strip or ribbon in a lateral direction reveals the net-like structure. In a variation of this means, the roller consists of peripherally mounted rows of hacksaw blades which rotate in relation to the moving ribbon to form the staggered slits or perforations and the fibrils along the length of the ribbon. The fibrillating ribbon can also be prepared by an embossing method wherein a grooved or embossing roll rotates against a second roll, the ribbon passing therebetween. The embossed ribbon is then oriented. Orientation causes rupturing in the thinner sections resulting in a fibrillated ribbon. U.S. Pat. No. 3,369,435, filed Dec. 6, 1967, issued Feb. 20, 1968 to H. D. Boultinghouse illustrates a rotating pin roller technique that can be adapted for making heavily fibrillated ribbon.

As used hereinafter, heavily fibrillated refers to initial ribbons having a denier of 1000 to 2600, e.g. 1400 to 1800, and having fine fibril backbones or stems connected by even finer fibrils resembling a web or net-like structure wherein the connecting fibrils have a denier of less than 250, ranging from about 3 to about 250, the average denier ranging from about 12 to about 150. A preferred heavily fibrillated ribbon is one having the above described web or net-like structure with interconnecting fibrils having a denier ranging from about 3 to 235 with an average denier of from 12 to about 125. A particularly preferred heavily fibrillated ribbon is one in which the fibrils have a denier of 3 to about 235 with an average denier of from 12 to about 150, a majority of the fibrils having a denier of less than 60, and at least 30% of the fibrils in the network have an average denier of about 12 to about 35.

Preferred ribbons used are from 0.5 to about 4 mils thick and 30 to 200 mils wide, more preferably from about 1.0 to about 3.0 mils thick and 50 to 150 mils wide. A particularly preferred ribbon is about 1.5 to 3.0 mils thick and from about 60 to about 100 mils wide, and can have smooth or delustered surfaces. A preferred fabric is woven in a plain weave for convenience and on an ordinary double-heddle loom using the above ribbons in the warp and the heavily fibrillated ribbons in the fill. Some of the warp yarns may be folded during weaving which beneficially aids in maintaining the strength of the fabric while providing a somewhat more open weave having interstices that facilitate the passage of the latex adhesives normally used in the carpet industry. Ribbon yarn folding during weaving, however beneficial, is not necessary to the successful carrying out of the invention.

The heavily fibrillated yarn is obtained by various means in any convenient manner. For fibrillation, the film can be from about 0.5 to about 3 mils thick, more often from about 0.5 to about 2 mils thick and of almost any desired width. It has been found convenient to slit a wide film of these thicknesses into ribbons of about 0.25 inch to about 1.0 inch wide and thereafter fibrillate them. It has also been advantageous to deluster the film or ribbon prior to fibrillation by running the film over a rotating sandpaper covered roll.

The ribbon used to produce the warp and fill members can be produced from a single extruded film. In this instance, the film is slit into ribbons of approximate width which can thereafter be used as desired. For example, the extruded film can be slit into one or more wide films and each of these films further slit into ribbons of the desired width depending upon their use as ribbon members or fibrillated members in the fabric. Thus, both members can be produced from a single extruder from the same source of material and in a continuous, uninterrupted process. Alternatively, the ribbons of different widths can be prepared on a single slitter which has its slitting elements suitably arranged to slit the film into ribbons of the desired widths, after which the ribbons are oriented, delustered if desired, and separated according to whether they are to be fibrillated or used directly in weaving the fabric.

A preferred method for preparing heavily fibrillated ribbon yarn utilizes the above-mentioned film slitting techniques to form ribbons of suitable dimensions which are thereafter oriented, then transported over a rotating roll fitted with pins on the outer periphery at specified angles. The ribbon is perforated in a pattern of slits determined by the pin positions, the angle of the pins and the ribbon speed in relation to the peripheral speed of the roller. The result is the web or network of fine fibers or fibrils interconnecting the longitudinally extending branches, ribs, backbones or channels above described. A particularly desirable pin roll is one in which there are parallel multiple rows of pins, up to 90 or more, positioned around the periphery of the roll, the pins in each row being off-set a specified distance with corresponding pins in each other row to create a pattern of pin positions which is repeated several times over the entire roll surface. The pins are angled toward the approaching ribbon to facilitate disengagement of the pins from the fibrillated ribbons. As mentioned above, the roll rotates at a speed somewhat faster than the ribbon moving thereover in a ratio of roll to ribbon speed of in excess of 1.0 to about 2.5 times depending upon the extent and type of fibrillation network desired. After the ribbon is fibrillated, it is wound up on a package for use in forming the entangled fibrillated film/multi-filament member as the fill or warp members in the woven fabric. A fibrillation method or technique employing the pin roller that has been useful is described in detail in Example A herein.

In addition, synthetic materials can be prepared which have flame retardant properties and used as the ribbons in the present fabrics, by blending them with one or more flame retardant additives. The polyamides in general have good flame resistant qualities. Other extrusion nylons, e.g., modified phenylene oxide based resins, are available which have excellent flame retardant properties and can be used herein. Brominated polyester is available as a flame retardant material and can be used, as well as polyester compounded with halogenated hydrocarbons. Many additives, both organic and inorganic are known and can be used to produce flame retardant polyester and the polyolefins. For example, these synthetics can be compounded with chlorinated paraffins, either singly or in combination with antimony oxide. Combinations of halogenated organic compounds and antimony oxide are also well-known as are perchloropentacyclodecane and related products. New bromine substituted aromatics and mixed halogen substituted aliphatics have recently been introduced and may also be used with the polyolefins, polyproplyene in particular. Other additives which can be used include, but are not limited to inorganics such as tri-hydrated aluminum oxide, and antimony oxide dispersions. The advantages of a flame retardant carpet backing are apparent—safer, fire resistant carpeting can be supplied to those areas and locations where flame retardant materials are required by present day regulations, building codes, and State and Federal statutues.

A useful method for determining fibril denier is one based on direct observation and mensuration of a selected number of fibrils from the fibrillated member. In this method, fibril specimens are embedded in a plastic matrix and cut to reveal cross-sections. The cross-sectioned specimens are viewed through a microscope, the fibril width and thickness determined by direct measurement, and the denier calculated. Alternatively, photomicrographs of the fibrils are made, the fibril width and thickness are scaled therefrom and the denier calculated.

To insure a reasonably representative fibril denier profile, from 30 to over 100 or more observations should be made. In another method for determining fibril denier, also based on direct observation, a Shadowgraph with a 10 power graduated width gauge lens is used. Specimens are mounted and viewed on smooth surfaced circular steel rods. Observations of fibril lengths and thicknesses and denier computations are made in sets up to 30 fibrils.

Fibril denier can also be determined by vibroscope as described in ASTM Designation D-1577, "Linear Density of Textile Fibers," Method A-Vibroscope method. This method is based upon a determination of the fundamental resonant frequent of transverse vibration in a fiber (or fibril) being measured and is primarily used to measure denier in symmetrical fibers. The fibrils of interest herein, obtained by fibrillating a ribbon, are asymmetrical and variations in resonant frequency may be observed depending upon positioning of the fibrils in the apparatus; it may therefore be difficult to obtain measurements using the vibroscope method.

In accordance with the present invention, the fibrillated ribbon prepared as herein described is entangled with a multi-filament yarn to form the warp or fill member. The nature of the multi-filament yarn is not critical, and a wide variety of continuous filament synthetic materials may be employed including polyolefin, polyester, acetate, acrylic and, preferably, polyamide filaments. Total filament denier and denier per filament of the multi-filament yarn are not critical. Overall filament denier may range from 150 to 1000, for example, 150 to 840, and the individual filaments of the multi-filament yarn may range from 2 to 50 DPF (denier per filament), preferably 4 to 6 DPF. Although round filaments are preferred, any of the wide variety of known cross-sectional filament shapes may be employed. Further, the multi-filament yarn may be textured or twisted, as desired.

In the preferred method of entangling the fibrillated ribbon and multi-filament yarn, wound-up packages containing the respective materials are mounted on spools, and the ends of the respective packages are passed over or through appropriate guide bars or rings and brought togther in an entangling jet which causes a high pressure fluid to impinge on the materials and cause entanglement. The free end of the entangled combination is attached to a take-up spool where it is wound-up on a package suitable for use in the subsequent weaving operation to form the fabrics of the invention. Although not required, a slight tension is ordinarily maintained on the fibrillated ribbon and multi-filament yarn, e.g., 0–50 grams, preferably 10–12 grams. Tension is established as a result of a difference in the RPM's of the packages containing the starting materials and the take-up spool. Typically, the fibrillated ribbon will comprise 60 to 80 wt. % of the entangled finished product, the remainder being the multi-filament yarn. The multi-filament yarn can be used in amounts ranging from as low as 10 wt. % to any desired upper limit to achieve improved adhesion levels as compared to materials made without the incorporation of a multi-filament yarn. In the preferred embodiment, 18 to 23 wt. % of a polyamide multi-filament yarn is employed based upon economic considerations.

Air entangling jets of the type which are useful in the practice of this invention are known in the prior art and have been used for the purpose of texturizing or otherwise modifying the physical characteristics of yarn. See, for example, U.S. Pat. Nos. 4,223,520; 4,152,885; 4,064,686; 4,035,883; 3,846,968; and 3,775,955. Typically, such jets comprise a passageway (of variable length) for the material being treated which is defined by inlet and outlet orifices. These orifices may vary in size and/or shape. One or more fluid inlet orifices are located at some intermediate point in the passageway through which flows a pressurized fluid, normally air, so as to impinge on the material being treated. Air pressure and flow rates are controlled by suitable valves for that purpose, as well as by the dimensions of the jet including the dimensions of the aforementioned orifices.

For the purpose of the present invention, such dimensions are not critical. The air jet pressure will normally be in the range of 80 to 175 psig, preferably, 20 to 175 psig, e.g., 165 psig, and the entangled yarn will be processed at a rate of 300 to 1000 feet per minute, preferably 650 to 800 feet per minute.

Fabrics woven from the entangled fibrillated ribbon/multi-filament yarn combination of the invention exhibit exceptionally high delamination strengths without after treatments or further processing of the woven fabrics as described in U.S. Pat. No. 4,145,467. Delamination strength is determined by adhering a secondary backing to a faced fabric, pile fabric or soft carpet fabric using a commercial rubber latex compounded with 73% solids and measuring the force in pounds required to peel the secondary backing from the soft carpet fabric of a strip 3 inches wide at a rate of 12 inches per minute. This test is standard throughout the carpet industry and a value of less than 7.5 pounds is considered unacceptable.

The invention is further illustrated by the following examples, and it should be noted that although polypropylene has been used herein, comparable results can be obtained with other synthetic thermoplastic materials, including polyamide, polyester, and other polyolefins as well as mixtures thereof.

EXAMPLE 1

This Example illustrates a preferred process for preparing the fibrillated ribbon.

A polyproplylene film approximately 20 inches in width and 2.5 to 3.0 mils thick was extruded through a screw extruder, the heat zones from feed end to die in the extruder increasingly varying from 400° to 470° F. After leaving the extruder, the film was hot stretched in air before being quenched in an 100° F. water bath. The film was then slit into equal width ribbons and oriented passing them through increasingly hotter zones from 250° to 310° F., for a total orientation of 6.3 to 1.0. The ribbons were annealed at 310° F., and delustered by passing them over rotating sandpaper covered rolls.

The delustered ribbons were then fibrillated by contacting a pin roller over an arc of approximately 40°. The ribbons entering the pin roll were under tension and left the roll under about half the initial tension. The pins were arranged around the roll periphery in 90 rows, over 30 pins to the inch in each row and mounted at an angle less than perpendicular to the roll surface. The pins were alternately off-set from row to row a distance of under 0.005 inches and repeated several times around the roll. The ratio of roller speed to ribbon speed was 1.2:1 to 1.5:1.

The ribbon thus fibrillated was wound onto packages by a winding machine. Some of the fibrillated ribbon was twisted 0.5 to 1.52 T.P.I. and the remaining ribbons were left untwisted. Both ribbons were rewound on a rewinding machine. After winding, the packages were transported to looms for weaving into fabrics as twisted or untwisted warp or fill yarns therein with polyproplene ribbon.

The fibrillated ribbons above prepared had a denier of approximately 2300, a tensile strength in excess of 10 pounds (ribbon yarn tenacity 2.0 grams per denier), and low shrinkage (under 1.5% tested at 270° F. for 15 minutes). Fibrillation was characterized visually by laterally expanding a portion of the ribbon to reveal multiple, longitudinally extending backbones, branches, stems or ribs with a laterally deployed, connecting lattice of fine fibers or fibrils.

EXAMPLE 2

A series of fabrics were woven from an entangled yarn consisting of 81.8 wt. % of an 1800 denier fibrillated polypropylene ribbon and 18.2 wt. % of the multi-filament yarn described in the table below as the fill member of a secondary backing fabric. In each case, the fabric construction consisted of a 16.5×7 leno weave. The yarn in each instance was entangled by passing the fibrillated ribbon and multi-filament yarn through an air jet at a rate of 650 feet per minute under a tension of 10 to 12 grams utilizing an air pressure of 165 psig. The air jet had a yarn passageway approximately 0.875 inches in length, a passageway inlet orifice diameter of 0.250 inches, a passageway outlet orifice diameter of 0.125 inches, and an air inlet orifice diameter of 0.125 inches located a distance of about 0.250 inches from the passageway inlet and arranged to permit the air to impinge on the ribbon and multi-filament at an angle of approximately 90°. The delamination strength values set forth in the table below were determined by the standard technique previously described herein.

| FILAMENT YARN | | | DELAMINATION VALUE |
|---|---|---|---|
| Denier | No. of Filaments | Type | |
| 840 | 136 | nylon | 18.6 lbs. |
| 420 | 60 | nylon | 16.3 lbs. |
| 400 | 72 | nylon | 16.4 lbs. |
| 400 | 100 | nylon | 15.6 lbs. |
| 840 | 136 | nylon (texturized) | 25.2 lbs. |
| 420 | 60 | nylon (texturized) | 20.4 lbs. |
| 400 | 72 | nylon (texturized) | 17.2 lbs. |
| 600 | 12 | propylene (textured) | 17.4 lbs. |
| 600 | 12 | propylene (twisted) | 14.6 lbs. |
| 600 | 12 | propylene | 14.9 lbs. |
| 600 | 24 | propylene | 15.7 lbs. |
| 350 | 40 | propylene | 14.9 lbs. |
| 1000 | 92 | polyester | 19.9 lbs. |
| 150 | 34/2 | polyester | 14.1 lbs. |
| 150 | 34 | polyester | 14.1 lbs. |
| 400 | 72 | nylon | 17.5 lbs. |
| 420 | 60 | nylon | 15.3 lbs. |
| 400 | 100 | nylon | 17.3 lbs. |
| 400 | 70 | propylene | 17.3 lbs. |
| 400 | 72 | nylon (process speed 800 FPM) | 17.2 lbs. |
| 400 | 72 | nylon (air pressure 140 PSI) | 15.6 lbs. |
| 400 | 72 | nylon (air pressure 120 PSI) | 15.4 lbs. |

EXAMPLE 3

A series of experiments were run in which the delamination strength performance of the entangled fibrillated ribbon/multi-filament yarn of the invention was compared with identically processed and woven materials from which the multi-filament yarn was omitted, i.e., the fibrillated ribbon alone was subjected to air jet processing without entanglement of a multi-filament yarn. In all cases, 1800 denier fibrillated polypropylene ribbon was employed, and the same processing speed, air pressure, air jets and weaving method were used. The results are tabulated below.

| DELAMINATION STRENGTH | |
|---|---|
| With Entangled Nylon Multi-Filament Yarn | Without Entangled Multi-Filament Yarn |
| A. 17.5 | A. 12.2 |
| B. 15.3 | B. 12.8 |
| C. 16.3 | C. 13.2 |
| D. 17.2 | D. 13.3 |
| E. 16.4 | E. 13.9 |

The foregoing results demonstrated the improvement provided by the invention.

The fabric of the invention also is useful for bags and sacks as a burlap replacement and overcomes the problems of previous synthetic yarn fabrics for this use in that the use of a fibrillated yarn in the warp or fill of the fabric induces high friction between them and the smoother ribbon yarns, thereby stabilizing the fabric such that it can easily contain heavy loads even of loose material.

What is claimed is:

1. A woven secondary backing material comprising warp members and fill members, one of said warp and fill members comprising unfibrillated or substantially unfibrillated synthetic ribbons, the other of said warp and fill members comprising heavily fibrillated synthetic ribbon entangled with continuous, multi-filament synthetic yarn, said backing characterized by a delamination strength greater than 15 pounds.

2. The synthetic fabric of claim 1, wherein the other of the warp and fill members comprises unfibrillated or substantially unfibrillated ribbons of polyolefin, polyamide, polyester or mixtures thereof, said ribbons being from 0.5 to 4 mils thick and from 30 to 120 mils wide.

3. The secondary backing of claim 1, wherein said heavily fibrillated yarn is a polyefin and said multi-filament yarn is a polyamide.

4. The second backing of claim 3, wherein said unfibrillated or substantially unfibrillated ribbons are from 0.5 to 4 mils thick and from 30 to 120 mils wide, the fibrils in said heavily fibrillated polyolefin ribbon are from 3 to 235 denier and have an average denier of from about 12 to about 150, and the multi-filament yarn has a total denier of about 150 to 1000 and a denier per filament in the range of from 2 to 50.

5. The fabric of claim 1, where the fibrillated and unfribillated synthetic ribbons are polypropylene.

6. The fabric of claim 1, wherein said multi-filament yarns are selected from the group consisting of polyolefins, polyesters, acrylics and polyamides.

7. The fabric of claim 1, wherein said multi-filament synthetic yarn is a polyamide.

8. A woven secondary backing material comprising warp members and fill members, one of said warp and fill members comprising unfibrillated or substantially unfibrillated synthetic ribbons, said unfibrillated ribbons being from 0.5 to 4 mils thick and from 30 to 120 mils wide, the other of said warp and fill members comprising heavily fibrillated polyolefin ribbon entangled with continuous, multi-filament polyamide yarn, said polyolefin ribbon having a denier of from 3 to 235 and an average denier of from about 12 to about 150 and said polyamide yarn having a total denier of about 150 to 1,000 and a denier per filament in the range of from 2 to 50.

* * * * *